US006554029B1

(12) United States Patent
Hofstetter et al.

(10) Patent No.: US 6,554,029 B1
(45) Date of Patent: Apr. 29, 2003

(54) METHOD FOR MOUNTING A NEW HARNESS ON A SEAM WEAVING MACHINE, APPARATUS FOR MAKING A FLAT WOVEN FABRIC ENDLESS AND HARNESS CARRIAGE

(75) Inventors: Edgar Hofstetter, Hohenstein (DE); Ernst Gluck, Hohenstein (DE); Hans Eugen Hacker, Reutlingen (DE)

(73) Assignee: Wagner Finckh GmbH, Reutlingen (DE)

( * ) Notice: Subject to any disclaimer, the term of this patent is extended or adjusted under 35 U.S.C. 154(b) by 0 days.

(21) Appl. No.: 09/580,320

(22) Filed: May 26, 2000

(51) Int. Cl.[7] ..... D06H 5/00
(52) U.S. Cl. ..... 139/383 AA; 28/141; 28/208
(58) Field of Search ..... 139/383 AA; 28/141, 28/208

(56) References Cited

U.S. PATENT DOCUMENTS

| | | | | |
|---|---|---|---|---|
| 4,557,025 A | | 12/1985 | Eglin | 28/141 |
| 4,581,794 A | | 4/1986 | Oldroyd et al. | 28/141 |
| 4,862,566 A | | 9/1989 | Hacker | 28/141 |
| 5,027,483 A | * | 7/1991 | Anderson | 139/383 AA |
| 5,117,542 A | * | 6/1992 | Krenkel et al. | 139/142 |
| 5,355,911 A | * | 10/1994 | Kuster et al. | 139/383 AA |
| 5,386,854 A | | 2/1995 | Hacker | 139/85 |
| 5,394,596 A | * | 3/1995 | Lindenmuller et al. | 28/208 |
| 5,636,663 A | | 6/1997 | Lacroix | 139/86 |
| 5,791,382 A | | 8/1998 | Froment et al. | 139/85 |

FOREIGN PATENT DOCUMENTS

DE 42 13 958 C1 4/1993

* cited by examiner

*Primary Examiner*—John J. Calvert
*Assistant Examiner*—Robert H Muromoto, Jr.
(74) *Attorney, Agent, or Firm*—Graybeal Jackson Haley LLP

(57) ABSTRACT

A harness for a seam weaving machine including a Jacquard machine is prepared while the shedding mechanism is removed from the seam weaving machine. The prepared shedding mechanism is then mounted on the seam weaving machine. The twines extending from the Jacquard machine and the harness cords connected to eyelets of the shedding mechanism are coupled collectively. The seam strip weft threads can be drawn in through the shedding mechanism while it is remote from the seam weaving machine.

9 Claims, 12 Drawing Sheets

METHOD FOR MOUNTING A NEW HARNESS ON A SEAM WEAVING MACHINE, APPARATUS FOR MAKING A FLAT WOVEN FABRIC ENDLESS AND HARNESS CARRIAGE

BACKGROUND OF THE INVENTION

1. Field of the Invention

The invention relates to a method for mounting a harness on a seam weaving machine, an apparatus for making a flat woven fabric endless by means of a woven seam joining together opposite ends of the fabric and a harness carriage for use in the harness mounting method. Forming fabrics used in the wet end section of papermaking machines have to be made endless by a woven seam. The weave pattern is continued exactly in the woven seam so that the joining does not cause markings in the paper.

2. Related Prior Art

U.S. Pat. No. 4,581,794 and U.S. Pat. No. 4,557,025 disclose an automatic seaming machine for forming a seam in a length of woven fabric for joining opposite ends of the fabric together thereby to form an endless woven fabric belt. When using that machine, a strip of woven material, cut from one of the ends of the fabric, the so-called seam strip, is supported between the opposite ends of the fabric. The seam strip is clamped at one end and weights or springs are attached to the opposite end of this seam strip so that it is pulled taut. The warp threads are removed from the seam strip located between the opposite ends of the fabric leaving only the weft threads. The weft threads of the seam strip are drawn in through a shedding mechanism and are controlled by means of a Jacquard machine to form a shed opening. The opposite ends of the fabric each include a fringe formed by removing a majority of the weft threads within an end portion of approx. 20 cm. A few weft threads are left at the edge of the fringe to form a narrow lease functioning to maintain the warp threads of the fringe in the proper position and sequence and to maintain proper relative alignment of the warp threads with respect to each other. The woven seam is formed by separating a first one of the warp threads of the lease and drawing it through the shed opening formed by the weft threads of the seam strip. The shed is then changed and a warp thread drawn out of the lease at the opposite end of the strip is separated and woven into the weft threads of the seam strip. This cycle is repeated until a seam has been woven along the entire width of the fabric. The warp thread fringes and seam strip weft threads reproduce within the woven seam exactly the weave pattern of the fabric because the fabric has been thermoset after weaving so that the warp and weft threads of the fabric, which are synthetic monofilaments, are permanently crimped. The warp thread fringes and the seam strip weft threads will be forced by their thermoset crimp knuckles to cross each other exactly as in the fabric.

The automatic seam weaving machine comprises a Jacquard machine carriage which supports the Jacquard machine and the shedding mechanism including the heddling assembly and the spring box. A plurality of eyeletted heddles are mounted between the springs of the spring box and the vertically reciprocal hooks of the Jacquard machine. The heddles are designed such that they can be slidably placed over the weft threads so that the individual weft threads do not have to be threaded through the heddles. The heddling assembly is fixedly mounted on the Jacquard machine.

U.S. Pat. No. 5,386,854 discloses a seam weaving machine wherein the Jacquard machine is arranged slightly offset underneath the shedding mechanism, a plurality of harness cords extending vertically downward from the jacquard machine and being deflected by 180° prior to passage through the shedding mechanism to return springs secured in the machine above the shedding mechanism.

U.S. Pat. No. 4,862,566 discloses an auxiliary device for a seam weaving machine. The auxiliary device couples each seam strip weft thread drawn in through one of the heddles to a tensioning string of a tensioning device. Said auxiliary device simplifies the drawing in of the seam strip weft threads through the heddles of the shedding mechanism.

U.S. Pat. No. 5,791,382 discloses a separable collar or coupling for the harness of the Jacquard machine. The separable collar enables a simple and quick connection and disconnection of a twine to one or several harness cords which in turn are fastened to the eyeletted heddles.

U.S. Pat. No. 5,636,663 discloses a harness system for weaving looms wherein all twines are releasably connected to one or several harness cords by means of couplings. The harness cords pass through openings in a plate which is reciprocally moveable so as to connect or disconnect all of the couplings simultaneously. In this way, the Jacquard machine can be disconnected from and reconnected to the shedding mechanism without the need to disconnect and connect each twine individually from the harness cords. A similar device for disconnecting and connecting a plurality of twines to harness cords collectively and simultaneously is disclosed in German Patent DE 42 13 958.

The width of the heddling assembly and the number of heddles or eyelets are fixed so that only small variations in the width of a woven seam and the density of the weft threads are possible with a specific heddling assembly. Each seam weaving machine can, therefore, be used only for fabrics within a narrow range of weave parameters. If a rather coarse fabric has to be made endless following a fine fabric on the same machine, the shedding mechanism has to be disconnected from the Jacquard machine and replaced by a shedding mechanism adapted to the coarser fabric. Such conversion of a seam weaving machine requires several days because each twine has to be disconnected from the harness cords of the previous shedding mechanism and reconnected to the harness cords of the new shedding mechanism separately.

Even if a fabric having the same parameters as the previous one has to be made endless, a standstill of several hours occurs because a new harness has to be drawn in, i.e. a new set of the seam strip weft threads has to be drawn in, through the eyeletted heddles or the eyelets. A Jacquard machine as used for a seam weaving machine includes, for example, 896 cords. Depending on the complexity of the weave pattern, it takes about 2 to 8 hours to draw in a new harness. A typical forming fabric for use in the wet end section of a papermaking machine has an average width of 7 meters. The opposite ends of such a fabric can be made endless by means of a seam weaving machine within about 10 to 15 hours. A standstill of several hours is, therefore, a considerable economic factor.

The weft threads of the seam strip cut from the fabric are arranged to form a shed opening so that they are used as or function as the warp thread in the seam weaving machine. Similarly, the warp thread fringes are drawn in through the shed opening so that they are used as or function as the weft threads in the seam weaving machine. The designations "weft threads" and "warp threads" are used here in accordance with the arrangement the threads had in the fabric rather than in accordance with their function in the seam weaving machine.

BRIEF SUMMARY OF THE INVENTION

The present invention provides a technique for adapting the design of a seam weaving machine quickly and without extended standstill periods of the seam weaving machine to the weave pattern and parameters of different fabrics. The improvement includes preparing the harness for a fabric having parameters differing from those of the previous fabric while the shedding mechanism is removed from the seam weaving machine and mounting the prepared shedding mechanism on the seam weaving machine, the twines and harness cords being coupled collectively.

Thus, in one aspect, the present invention provides a method for mounting a new harness on a seam weaving machine for making endless a flat woven fabric formed by interwoven warp and weft threads by means of a woven seam joining together opposite ends of the fabric, the opposite ends of the fabric each including a fringe of warp threads, the warp threads of the fringe being supported such that they can be interwoven with weft threads taken out of the fabric and drawn in through a shedding mechanism controlled by a Jacquard machine by means of twines and harness cords so that the weft threads drawn in form a shed opening, each of the harness cords being passed through one of a number of openings in a first plate, the harness cords being connected to the twines by means of couplings, each of the twines passing through one of a number of openings in a second plate, each coupling comprising a first and a second coupling element, each of the first coupling elements being fastened to a number of the harness cords and each of the second coupling elements being fastened to a twine, the first and second coupling elements being connectable by movement to a first position relative to each other and are disconnectable by movement to a second position relative to each other; the method comprising the steps of:

providing a harness carriage including first means for releasably supporting the shedding mechanism and second means for releasably supporting the first plate;

installing the shedding mechanism on the first supporting means;

installing the first plate on the second supporting means;

transferring the first plate from the second supporting means to the seam weaving machine and moving the first plate to the second plate so that all couplings will be moved together into the first positions so that the harness cords extending from the shedding mechanism are connected to the twines extending from the Jacquard machine; and releasing the shedding mechanism from the first supporting means of the harness carriage and fastening the shedding mechanism to the seam weaving machine.

Preferably, the seam strip weft threads are to be drawn in through the shedding mechanism while the shedding mechanism is detached from the seam weaving machine and is attached to the harness carriage. Another shedding mechanism can be mounted on the seam weaving machine in order to make a fabric endless in the meantime.

In another aspect, the present invention provides an apparatus for making endless a flat woven fabric formed by interwoven warp and weft threads by means of a woven seam joining together opposite ends of the fabric. The apparatus comprises:

a shedding mechanism suitable for the weft threads taken out of the fabric being drawn in through the shedding mechanism, the shedding mechanism being controllable by harness cords to form a shed opening with the drawn in weft threads, into which shed opening the warp threads of the fringe can be drawn through for interweaving with the weft threads;

a Jacquard machine for controlling the shedding mechanism by means of twines connectable to the harness cords;

separable couplings for selectively connecting and disconnecting the twines to the harness cords, each coupling comprising a first and a second coupling element, the first coupling element being fastened to at least one of the harness cords and the second coupling element being fastened to one of the twines, the first and second coupling elements being connectable by their relative movement up to a first position so that the harness cords are connected to the twines of the Jacquard machine and are disconnectable by further movement up to a second position so that the harness cords are disconnected from the twines of the Jacquard machine;

a first plate having a number of openings, each of the harness cords being able to be passed through one of the openings;

a second plate having a number of openings, each of the twines being able to be passed through one of the openings;

the first plate and the second plate being movable relative to each other so that all separable couplings can be moved together into the first and the second position; and the shedding mechanism, including the harness cords and the first coupling elements fastened thereto, and the first plate being disconnectable from the seam weaving machine.

Preferably, the movement by which the first and second coupling elements are connectable and disconnectable is a movement in axial direction of the first and second coupling elements.

Preferably, the first plate is a deflector plate and the second plate is a counterpressure plate, which are movable on guiding rods extending on a carriage carrying the Jacquard machine, the deflector plate being transferable onto similar guiding rods mounted on the harness carriage.

In still another aspect, the invention provides a harness carriage including means for holding the shedding mechanism, including the harness cords connected thereto and the first coupling elements fastened thereto, and the deflector plate in the same relative position as when they are connected with the seam weaving machine so that they are transferable from the seam weaving machine to the harness carriage.

Preferably, the harness carriage further includes a support for the shedding mechanism, the support including means for lowering and raising the shedding mechanism so that the harness cords can be tensioned and slackened.

Preferably, the harness carriage includes a support for storing the weft threads to be drawn in through the shedding mechanism and a support for a tensioning device for tensioning the drawn-in weft threads, the weft thread support being releasably attached to the harness carriage and the tensioning device being transferable from the seam weaving machine to the harness carriage.

New weft threads can be drawn in through the eyeletted heddles or eyelets of the shedding mechanism while the shedding mechanism is supported by the harness carriage. Another harness can in the meantime be mounted on the seam weaving machine so that the operation of the seam weaving machine does not have to be interrupted or stopped while new weft threads are drawn in.

DETAILED DESCRIPTION

Figure 1:
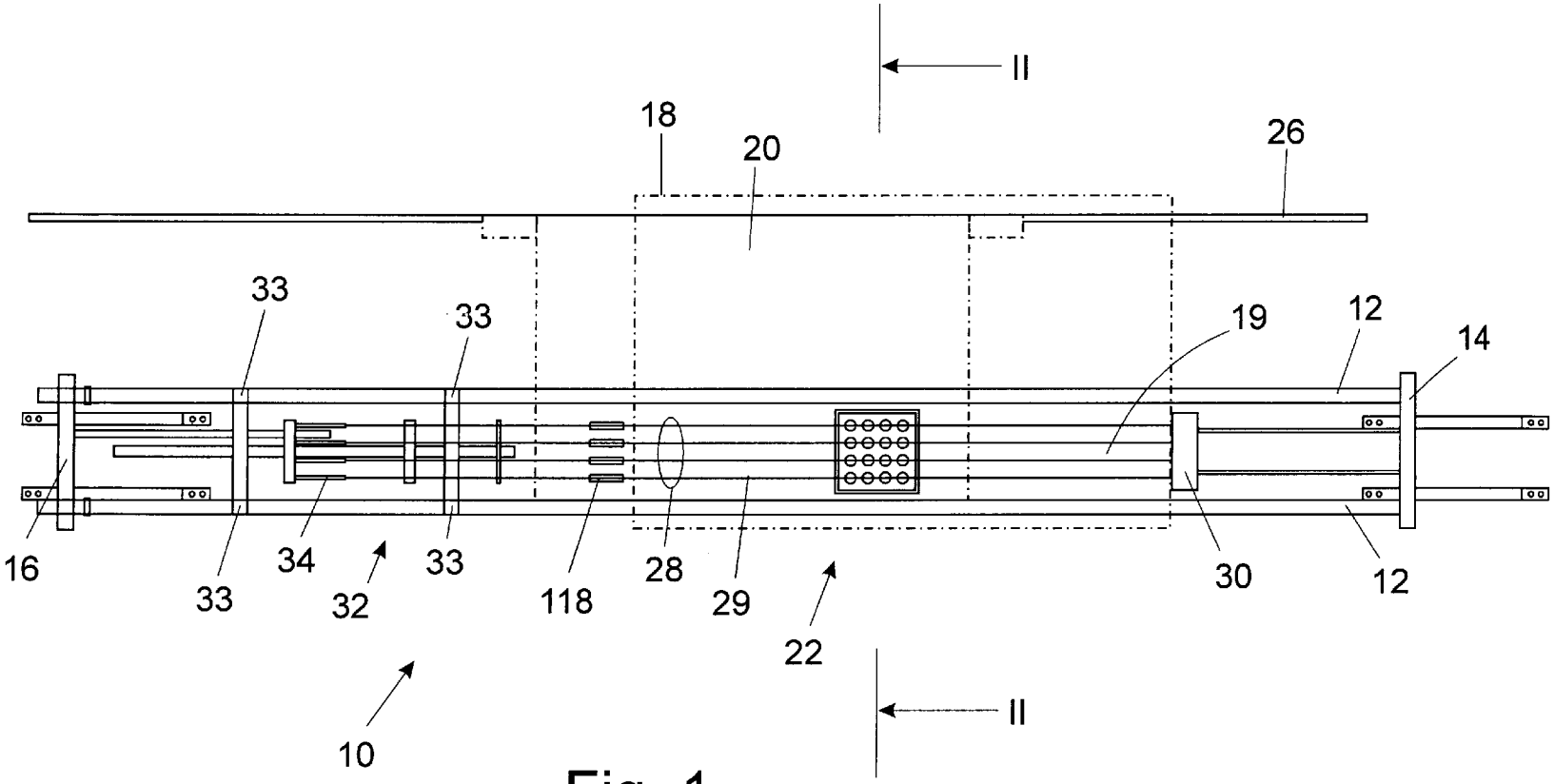
FIG. 1 is a top view of a seam weaving machine for making flat woven fabric endless by means of a woven seam, the fabric being shown dotted.
Figure 2:
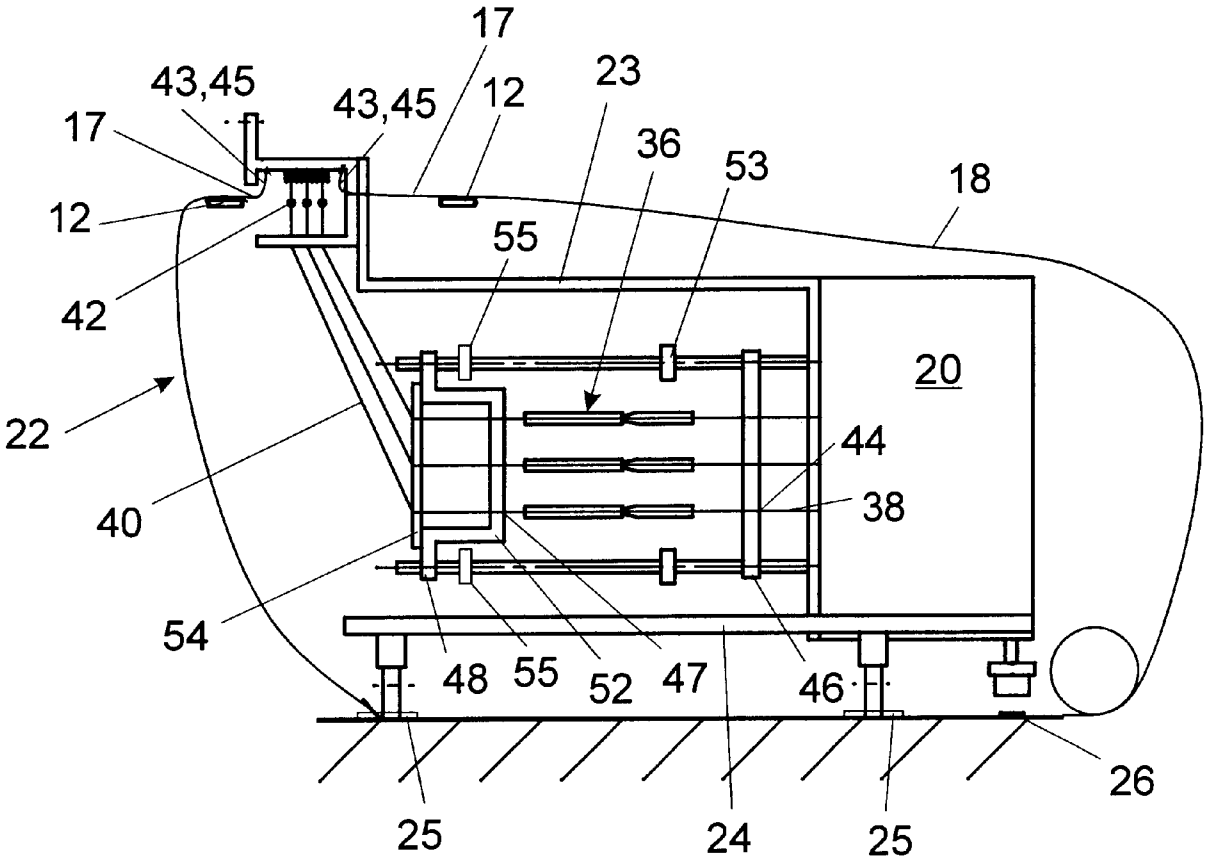
FIG. 2 is a schematic cross-section view along II—II of FIG. 1.

FIGS. 1 and 2 show a seam weaving machine 10 for joining opposite ends 17 of a fabric 18 by means of a woven seam 19. The seam weaving machine 10 comprises two elongated support elements 12 extending between forward and rearward standards 14 and 16 at a spacing of somewhat more than the width of the woven seam 19, typically 13 m. Tightening straps or belts are used as the two elongated support elements 12. The opposite ends 17 of the fabric 18 which are to be joined are clamped to the elongated support elements 12.

A Jacquard machine 20 and a shedding mechanism 22 are mounted on a Jacquard machine carriage 24. As shown in FIG. 2, the shedding mechanism 22 is held by a support beam 23 between the two elongated support elements 12 and the Jacquard machine 20 is held on the Jacquard machine carriage 24 below and beside the elongated support elements 12. The Jacquard machine carriage 24 will be guided parallel to the elongated support elements 12 by an induction rail 26. The opposite ends 17 of the fabric 18 to be made endless are clamped to the elongated support elements 12 and the fabric is passed underneath the Jacquard machine carriage 24. Protection belts 25 are laid on the fabric 18 so that it will not be damaged by the rolls of the Jacquard machine carriage 24. As is known, the fabric 18 can also be guided above the Jacquard machine carriage 24.

The drawings are not drawn at scale. The distance between the standards is e.g. 13 m while the Jacquard machine has a length of approx. 1.5 m.

A seam strip 28 extends between the forward standard 14 and the rearward standard 16. The seam strip 28 has been cut from one end of the fabric 18 and the warp threads have been removed from the seam strip 28 leaving only the weft threads 29. A few warp threads have been left at the one end of the seam strip 28 to hold the weft threads of the seam strip 28 together and maintain the order and relative alignment of weft threads in the seam strip 28. That end of the seam strip 28 is fastened to a fastening plate 30 at the forward standard 14. A tensioning device 32 is clamped by clamping jaws 33 to the elongated support elements 12 so that it is positioned between the elongated support elements 12 near the rearward standard 16. The seam strip weft threads 29 extend from the fastening plate 30 through the shedding mechanism 22 and then to the tensioning device 32 where the free ends of the seam strip weft threads 29 are fastened to coil springs 34 by means of weft thread couplings 118 so that the seam strip weft threads 29 are pulled taut.

The Jacquard machine 20 controls the shedding mechanism 22 by means of twines 38 coupled to harness cords 40 which in turn are connected to eyelets 42 of the shedding mechanism 22.

The opposite ends 17 of the fabric 18 each include a fringe 43 formed by removing a majority of the weft threads within an end portion of approx. 20 cm. The weft threads of two weave pattern repeats are left at the edge of the fringe 43 to form a narrow lease 45 functioning to maintain the warp threads of the fringe 43 in the proper position and sequence and to maintain proper relative alignment of the warp threads with respect to each other. The woven seam 19 is formed by separating a first one of the warp threads out of one of the leases 45 and drawing it through the shed opening formed by the seam strip weft threads 29. The shed is then changed and a warp thread drawn out of the lease 45 at the opposite end of the fabric 18 is separated and interwoven with the seam strip weft threads 29. This cycle is repeated until the seam 19 has been woven along the entire width of the fabric 18.

Thus far, the seam weaving machine 10 is conventional.

In accordance with the invention, the shedding mechanism 22 is designed such that it can be detached from the Jacquard machine carriage 24 and replaced by another shedding mechanism 22. The harness cords 40 remain connected to the shedding mechanism 22 and will be disconnected from the twines 38 for such a replacement. That construction enables conversion of a seam weaving machine 10 quickly for making endless by a woven seam a fabric having a completely different weave pattern.

The shedding mechanism 22 comprises a lower harness frame 60 and an upper harness frame 62. The lower harness frame 60 comprises a vertical opening for each of the harness cords 40. The harness cords 40 pass through the openings in the lower harness frame 60 and are fastened to the eyelets 42 which in turn are fastened to return springs 68 suspended from the upper harness frame 62.

The Jacquard machine 20 is arranged such that the twines 38 exit in horizontal direction from the Jacquard machine 20. The Jacquard machine 20 is the type LX61 of Stäubli Faverges SCA, F-74210 Faverges, France. It has CX modules for each group of eight hooks. This type of Jacquard machine is particularly suited for being mounted such that the twines 38 exit in horizontal direction from the Jacquard machine.

Figure 6:
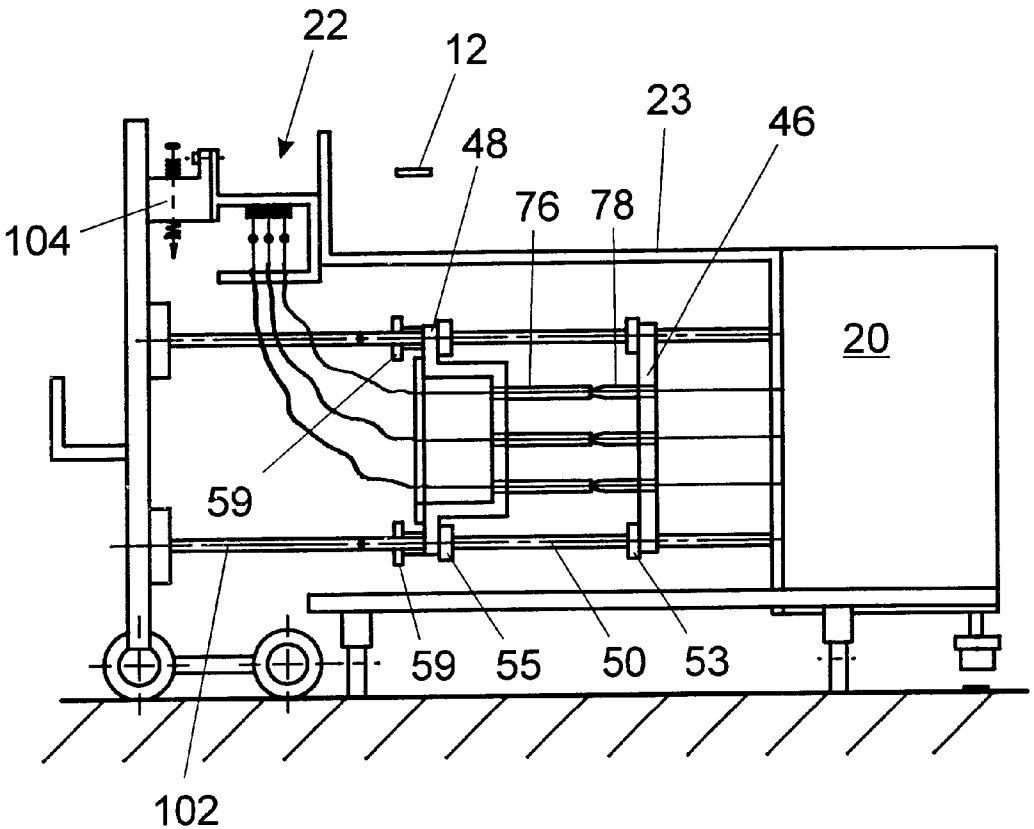

The twines 38 are guided horizontally through openings 44 in a counterpressure plate 46 and are connected by means of couplings 36 to the harness cords 40. The harness cords 40 are passed through openings 47 in a deflector plate 48. The counterpressure plate 46 and the deflector plate 48 are guided on guiding rods 50 extending horizontally and parallel to the twines 38 from the Jacquard machine 20. The counterpressure plate 46 can be moved on the four horizontal guiding rods 50 from a home position (FIG. 2) near the Jacquard machine 20 to a change position (FIGS. 4 to 7) in which the counterpressure plate 46 engages the couplings 36. The counterpressure plate 46 abuts first stops 53 in the change position. The deflector plate 48 is moveable on the four horizontal guiding rods 50 from a home position (FIG. 2) at the free end of the guiding rods 50 to a change position (FIG. 6), in which the deflector plate 48 abuts second stops 55. The distance between the stops 53, 55 is chosen such that the couplings 36 are in their second position and will be disconnected, when both plates 46, 48 abut the stops 53, 55. The counterpressure plate 46 and the deflector plate 48 can be tightened to the guiding rods 50 by suitable locking screws not shown in the drawings. The deflector plate 48 comprises a forward plate 52 which is proximal to the Jacquard machine 20 and a rearward plate 54. The harness cords 40 are deflected after the deflector plate 48 from the horizontal direction at an angle of approximately 60° upwards to the shedding mechanism 27 forming the weaving shed. The guiding rods 50 have a length sufficient to move the deflector plate 48 in such position underneath the shedding mechanism 22.

Figure 9:
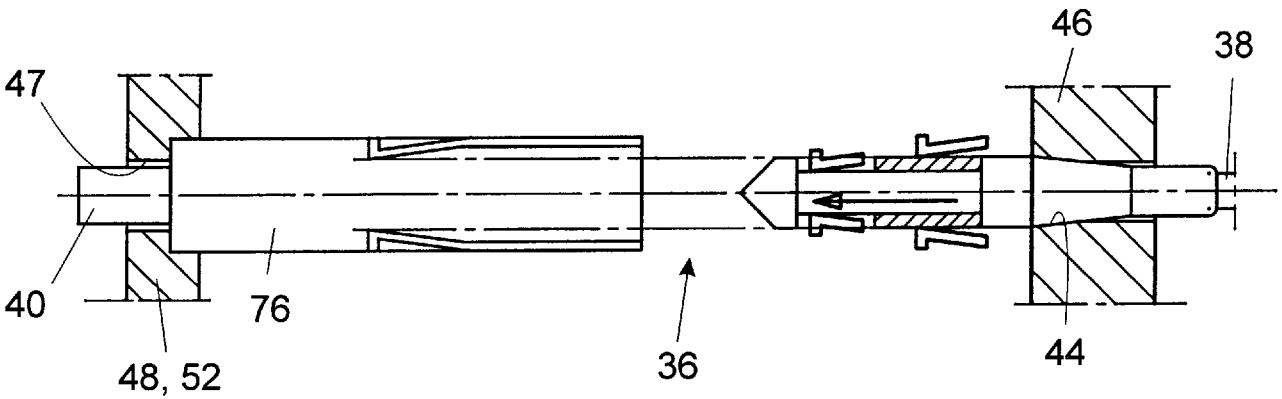
FIG. 9 shows in axial section the first and the second coupling elements separated from each other with the first coupling element being seated in the bore of the counterpressure plate and the second coupling element being seated in the bore of the deflector plate.

The couplings 36 (FIG. 9) for selectively connecting and disconnecting the twines 38 and the harness cords 40 are collars as disclosed in U.S. Pat. No. 5,791,382. Those couplings 36 comprise a first or socket element 76 and a second or male element 78. Each socket element 76 is fastened to at least a harness cord 40 and each male element 78 is fastened to a twine 38. The openings 44 through the counterpressure plate 46 are conical with the greater diameter facing to the deflector plate 48 so that conical ends of the male elements 78 can be held in the openings 44 of the counterpressure plate. The openings 47 in the forward plate 52 of the deflector plate 48 are counterbored, the enlarged opening facing the counterpressure plate 46 so that the cylindrical ends of the socket elements 76 can be held frictionally in the counterbored openings 47. A socket element 76 and a male element 78 are connected by inserting the male element 78 in axial direction up to a first position into the socket element 76. They are disconnected by continuing the axial insertion movement up to a second position, after which the male element 78 can be withdrawn completely out of the socket element 76.

Figure 10:
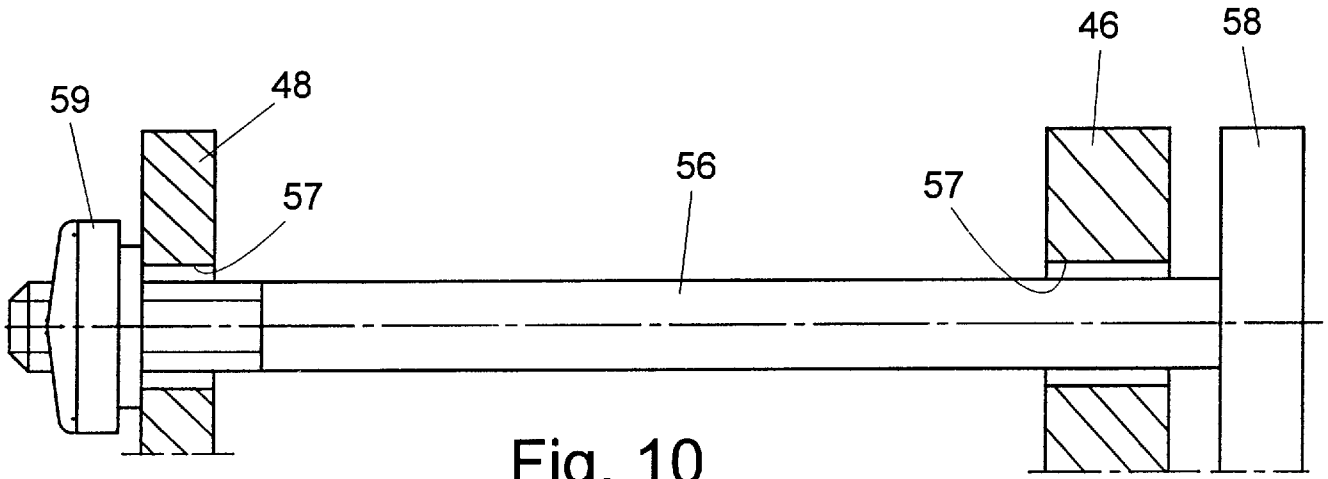
FIG. 10 shows the means for forcing the deflector plate towards the counterpressure plate for connecting first coupling elements to and disconnecting them from the second coupling elements.

A plurality of socket elements 76 can be connected at the same time with the corresponding male elements 78 by first moving the counterpressure plate 46 and the deflector plate 48 along the guiding rods 50 to each other from their home positions into their change positions so that the socket elements 76 are seated in the counterbored openings 47 and the male elements 78 are seated in the conical openings 44. Further axial movement of the counterpressure plate 46 and the deflector plate 48 will bring the couplings into their first position so that all couplings 36 are connected simultaneously. In the event that the couplings 36 are to be disconnected, the counterpressure plate 46 and the deflector 48 have to be moved closer to each other so that the couplings 36 are brought into their second position after which they can be disconnected from each other by return movement of the counterpressure plate 46 and/or the deflector plate 48. As shown in FIG. 10, the counterpressure plate 46 and the deflector plate 48 can be moved relative to each other by means of threaded rods 56 passing through openings 57 in the margin area of those plates 46, 48. A head 58 at the one end of the threaded rod 56 pushes against the counterpressure plate 46 and a star handle 59 is screwed onto the other end of the threaded rod 86 in order to move the plates 46, 48 towards each other.

Figure 14:
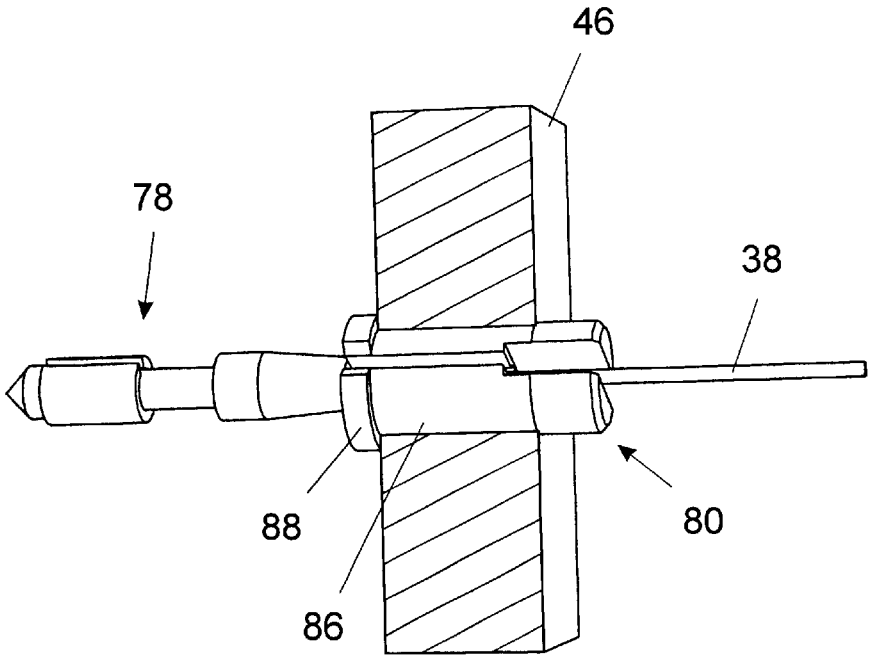
FIG. 14 shows a bushing inserted in the bore of the counterpressure plate.
Figure 13:
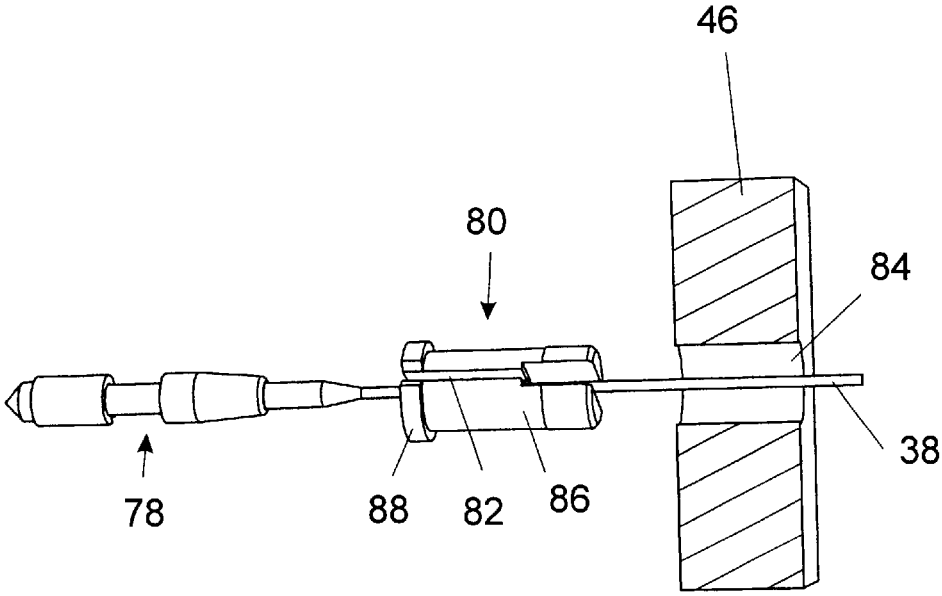
FIG. 13 is an exploded view of a bushing for the second coupling element.

As shown in FIGS. 13 and 14, the conical openings 44 in the counterpressure plate 46 are formed by synthetic resin bushings 80 having a radial slit 82. The bushings 80 are inserted into bores 84 of the counterpressure plate 46. Each bushing 80 has a cylindrical body 86 and an enlarged diameter collar 88 at its forward end. That collar 88 rests against the side of the counterpressure plate 46 facing the deflector plate 48. The diameters of the bores 84 and the outer diameters of the bushing main bodies 86 are slightly greater than the diameters of the male elements 78 so that the counterpressure plate 46 can be detached from the Jacquard machine 20 by pushing the bushings 80 out of the bores 84 and then drawing the male elements 78 through the bores 84. The bushings 80 can be detached from the twines 38 via the radial slit 82.

Figure 3:
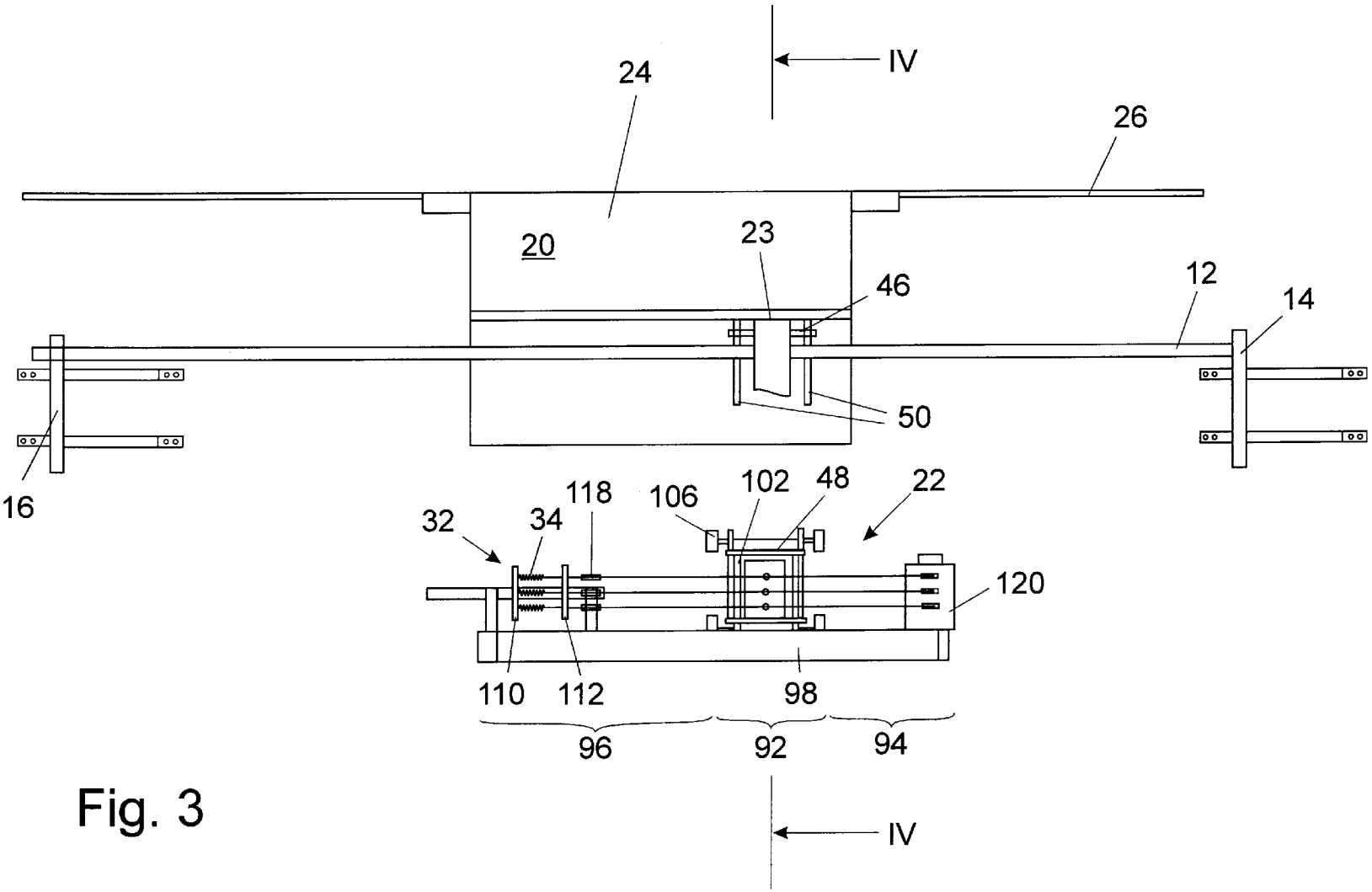
FIG. 3 is a top view of the seam weaving machine with the fabric having been taken out and the seam weaving machine being ready for mounting a new harness, a harness carriage with the new harness being shown spaced from the seam weaving machine.
Figure 11:
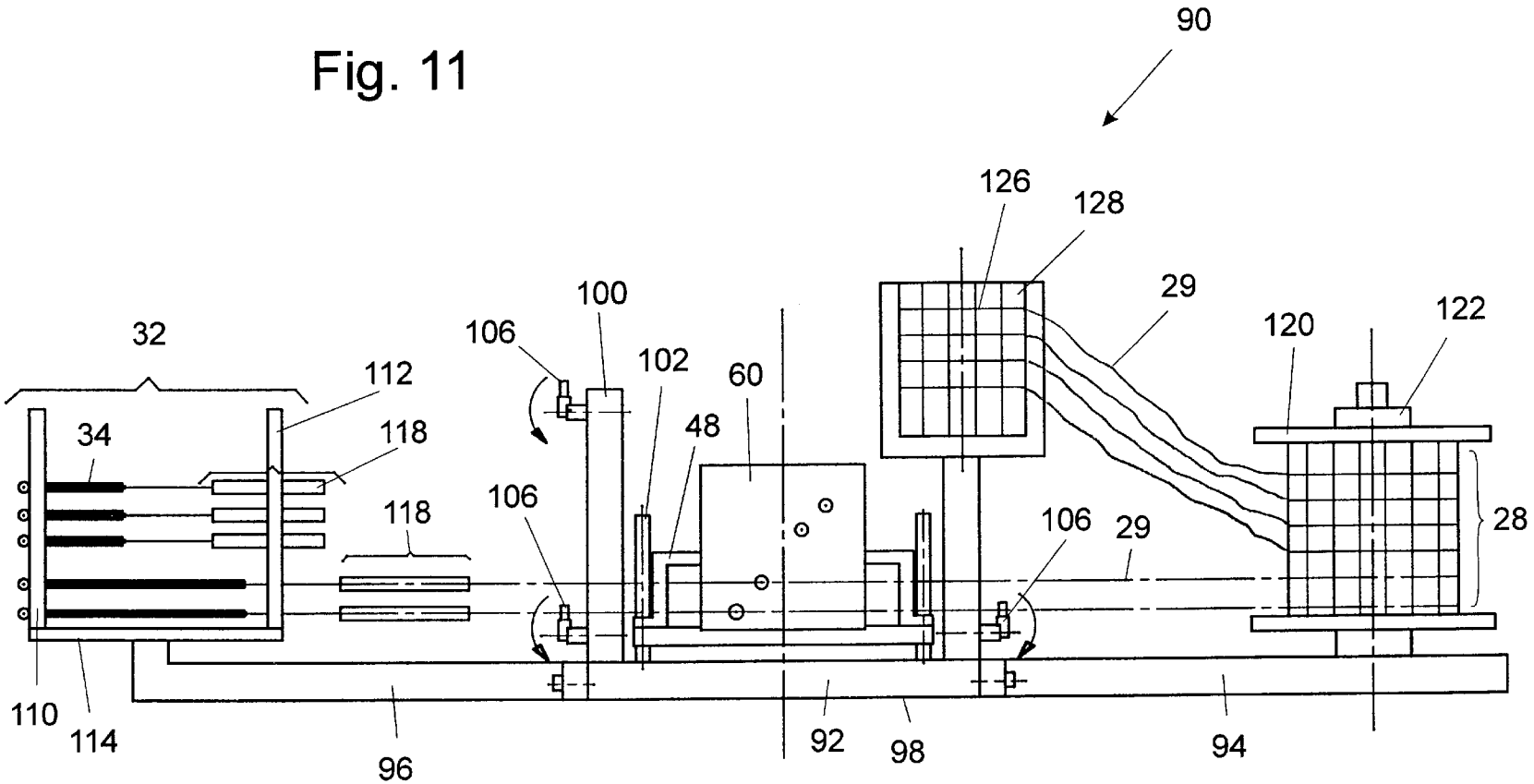
FIG. 11 is a top view of the harness carriage holding the seam strip bobbin, the fastening plate, the deflector plate, the lower harness frame and the tensioning device, part of the weft threads being drawn in through the eyelets and being drawn taut by the tensioning device.

The harness carriage 90 comprises a middle section 92, a right-hand side section 94 and a left-hand side section 96 (as seen in FIGS. 3 and 11). The right-hand side section 94 and the left-hand side section 96 will be neglected for the time being since they are of importance solely for a preferred embodiment of the invention described later on. The middle section 92 encompasses a vertical wall 98, two support beams 100 extending horizontally at the bottom end of wall 98, four guiding rods 102 and a lifting mechanism 104 for lifting and lowering the shedding mechanism 22 or at least the upper harness frame 62. A roll 106 is provided at each end of each support beam 100 so that the harness carriage 90 can be pushed or pulled in each direction. The four guiding rods 102 extending horizontally from the vertical wall 98 have the same height above the floor and the same distance between each other as the guiding rods 50 extending from the Jacquard machine 20 so that they can be brought into alignment with those guiding rods 50 by proper positioning of the harness carriage 24. The points of the Jacquard machine carriage guiding rods 50 and the points of the harness carriage guiding rods 102 can be provided with mutual engagement means like a conical point and a conical recess so that they form a continuous guiding rod when the harness carriage 90 docks onto the Jacquard machine carriage 24.

Figure 4:
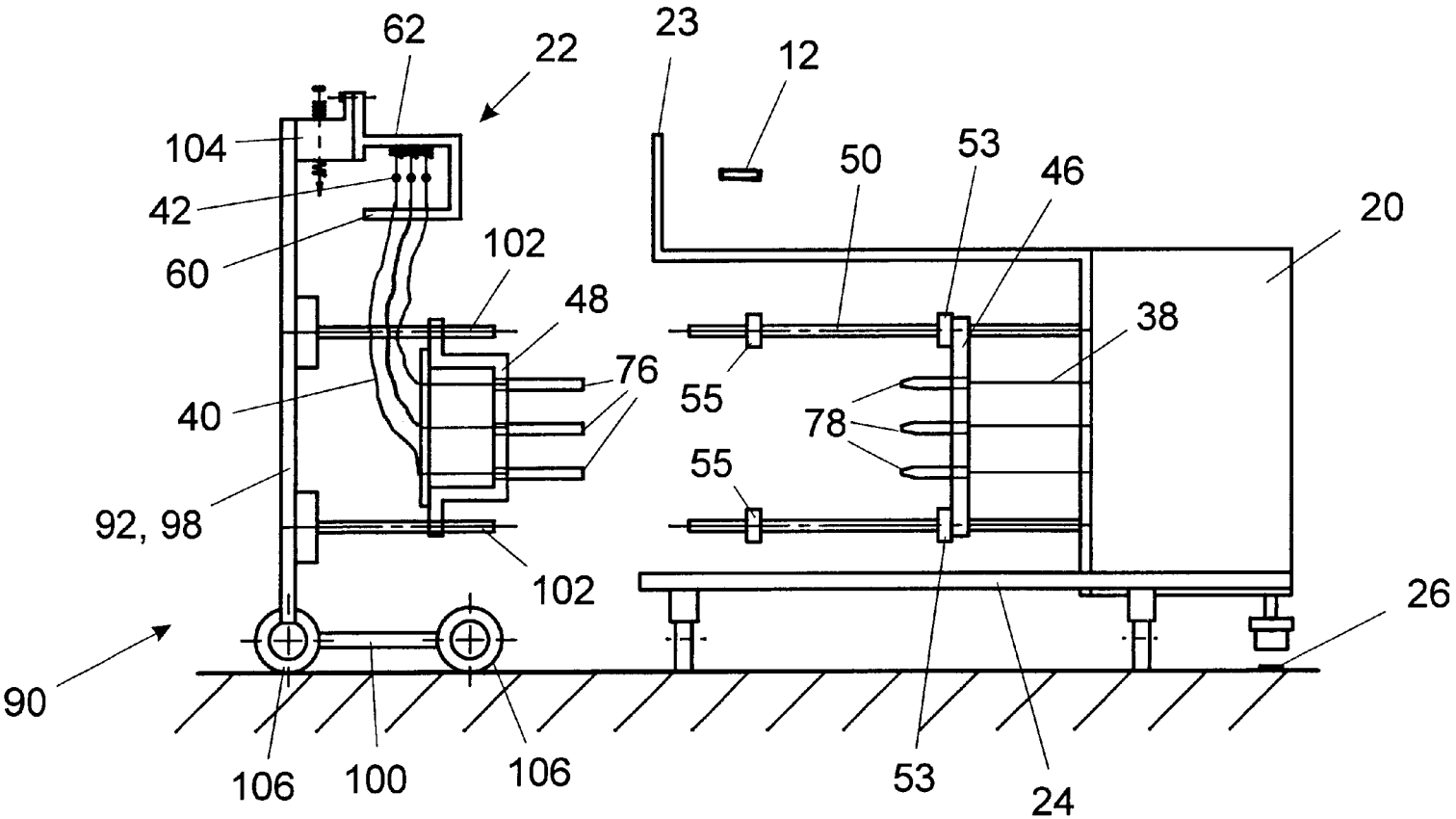
FIG. 4 is a schematic cross-section view along IV—IV of FIG. 3.
Figure 5:
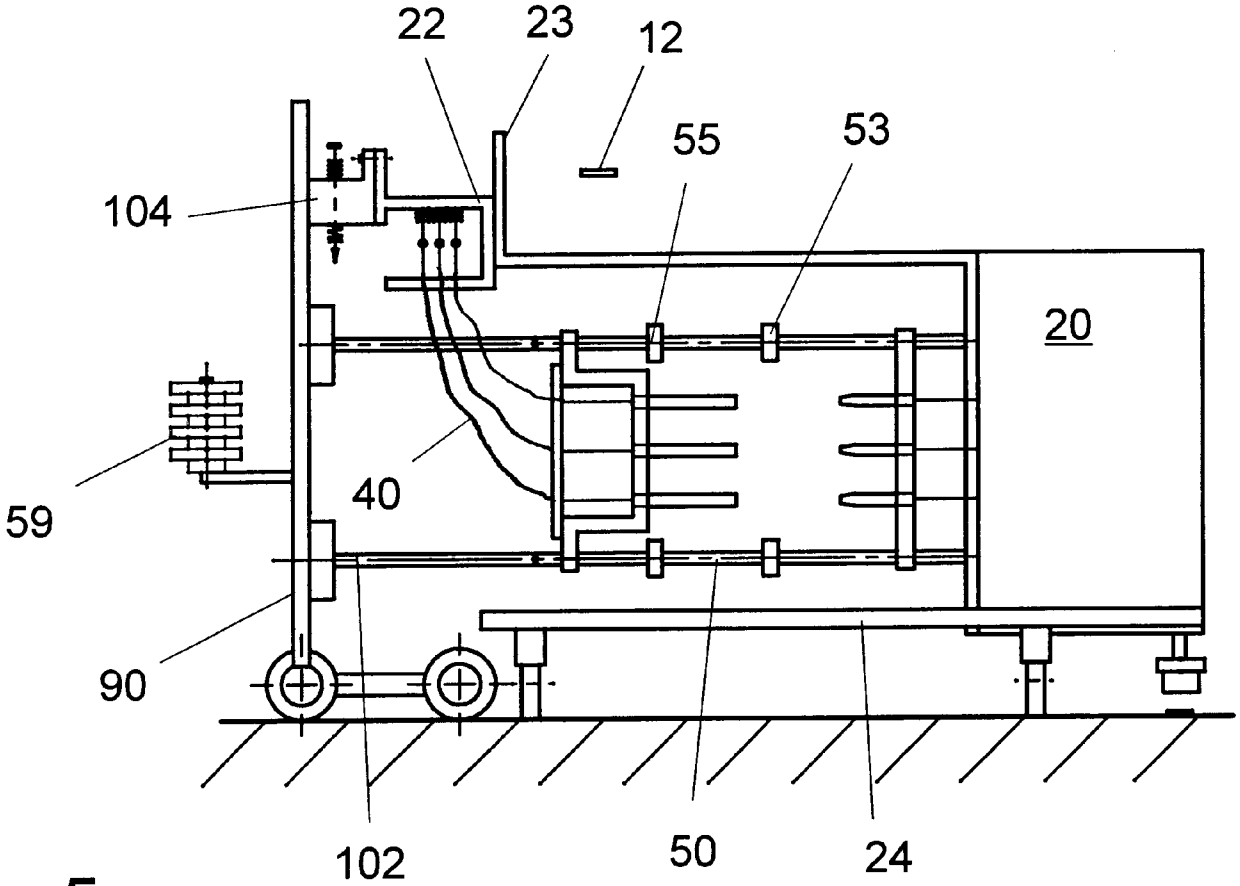
FIGS. 5 to 8 are schematic cross-sections similar to FIG. 4 showing the sequential steps carried out for mounting the new harness on the seam weaving machine.
Figure 7:
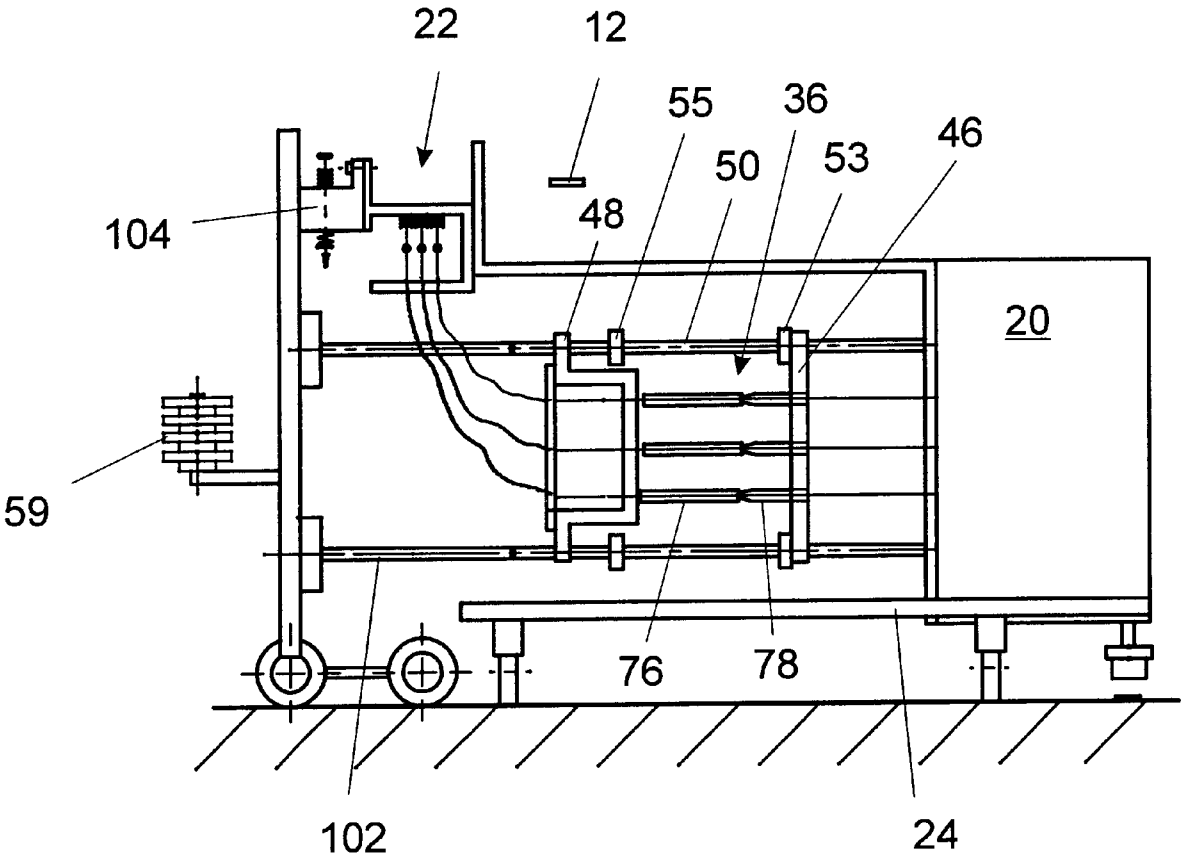
Figure 8:
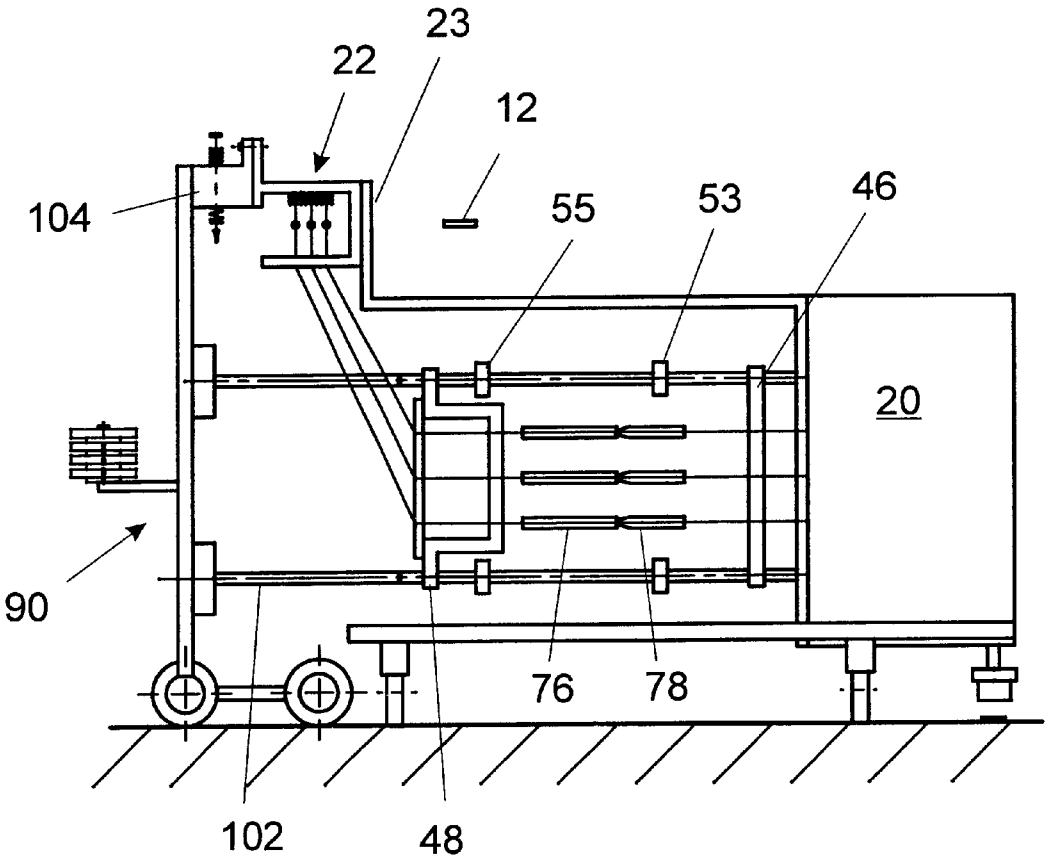

The transfer of a new harness will now be described. The shedding mechanism 22 comprising the new harness is mounted on the harness carriage 90, as shown in FIGS. 3 and 4, and is to be transferred to the seam weaving machine 10. It will be assumed that the fabric last made endless has been taken out of the seam weaving machine 10 and that the support element 12 proximal to the harness carriage 90 has been removed, so that the seam weaving machine 10 is "empty". The terms "upward movement stage" and "downward movement stage" of the Jacquard machine 20 refer to the up and, respectively, down position of the eyelets 42 rather than to the position of the hooks of the Jacquard machine 20. The various parts of the seam weaving machine 10 and the new shedding mechanism 22 have to be in the following positions and the following steps have to be carried out for mounting the new harness on the seam weaving machine 10:

1. The Jacquard machine 20 is in the upward movement stage.
2. The counterpressure plate 46 is forward (change position) so that the coupling male elements 78 are seated in the conical openings 44 of the counterpressure plate 46 (FIGS. 4, 9 and 14).
3. Coupling socket elements 76 are centered in the deflector plate 48 which is located on the harness carriage guiding rods 102 (FIG. 4).
4. Approaching with new harness on harness carriage 90 so that the harness carriage guiding rods 102 come into engagement with the Jacquard machine carriage guiding rods 50 (FIG. 5).
5. Relieving harness tension by lowering the shedding mechanism 22 (FIG. 5).
6. Moving the deflector plate 48 from the harness carriage guiding rods 102 onto Jacquard machine carriage guiding rods 50 (FIG. 5).
7. Disengaging the harness carriage guiding rods 102 from the Jacquard machine carriage guiding rods 50 and withdrawing the harness carriage 90 approx. 2 cm.
8. Screwing holding screws onto the ends of all four Jacquard machine carriage guiding rods 50 in order to avoid the deflector plate 48 sliding from guiding rods 50.
9. Moving the deflector plate 48 holding the socket elements 76 forward as far as to a distance of approx. 7 cm to the second stops 55 so that the socket elements 76 slightly engage the male elements 78.
10. Mounting the star handles 59 and moving the deflector plate 48 forward by turning the star handles 59 (FIG. 6).
11. Continuing to turn the star handles 59 until all of the couplings 36 are locked in their first position (recognizable clicking noise) (FIG. 6).
12. Removing the star handles 59 (FIG. 7). (They are stored on a hook at the backside of the wall 98.)
13. Moving the deflector plate 48 to its home position at the end of the Jacquard machine carriage guiding rods 50 and firmly fixing it by locking screws (FIG. 7).
14. Moving the counterpressure plate 46 to its home position (FIG. 8).
15. Tensioning the harness by raising the shedding mechanism 22 by means of the lifting mechanism 104 (FIG. 8).
16. Fastening the shedding mechanism 22 to the support beam 23 of the weaving machine 10 and detaching it from the harness carriage 90.
17. Moving the harness carriage 90 away from the seam weaving machine 10.

After that, the second support element 12 has to be reinstalled and the seam strip weft threads 29 have to be drawn in in conventional manner. A fabric 18 can then be laid into the seam weaving machine 10 and the opposite ends 17 of the fabric 18 can be clamped to the support elements 12 for the fabric 18 being made endless by a woven seam 19.

When the woven seam 19 has been finished, the support elements 12 will be removed and the fabric made endless will be taken out of the seam weaving machine 10.

If the following fabric largely has the same thread density and weave pattern as the previous one, the shedding mechanism 22 will be left in the seam weaving machine 10 and new seam strip weft threads 29 will be drawn in through the shedding mechanism 22. If the following fabric has a thread density and/or weave pattern rather different from those of the previous one, the shedding mechanism 22 will be replaced. The various parts of the seam weaving machine 10 and the new shedding mechanism 22 have to be in the following positions and the following steps have to be carried out for removing the shedding mechanism 22 from the seam weaving machine 10:

1. The Jacquard machine 20 is in the upward movement stage.
2. Approaching with the empty harness carriage 90.
3. Fastening the shedding mechanism 22 at the harness carriage 90 and detaching it from the support beam 23 of seam weaving machine 10.
4. Relieving the harness tension the shedding mechanism 22 by means of the lifting mechanism 104.
5. Releasing the deflector plate 48 from the home position and moving it towards the couplings 36 (change position) a distance of approx. 6 cm.
6. Engaging the harness carriage guiding rods 102 with the Jacquard machine carriage guiding rods 50.
7. Removing the holding screws from the ends of the Jacquard machine carriage guiding rods 50.
8. Programming the Jacquard machine 20 for the downward movement stage.
9. Moving the counterpressure plate 46 from the home position forward into the change position and tightening it slightly so that it moves on the guiding rods 50 when a force is exerted on it.
10. Rotating the main shaft of the Jacquard machine 20 (manually) up to the end position of the downward movement stage being reached.
11. Programming the Jacquard machine 20 for the upward movement stage.
12. Rotating the main shaft of the Jacquard machine 20 and moving counterpressure plate 46 holding the male elements 78 as far as to the first stops 53 (change position). Tightening the counterpressure plate 78.
13. Firmly tightening the counterpressure plate 46.
14. Moving the deflector plate 48 forward to the change position as far as to the couplings 36.
15. Mounting the star handles 59 and moving the deflector plate 48 forward by turning the star handles 59.
16. Continuing until the complete deflector plate 48 is resting against the second stops 55 so that the couplings 36 come into their second position and are unlocked.
17. Removing the star handles 59.
18. Releasing the deflector plate 48, moving it away from the second stops 55 (approx. 5 cm) and tightening it slightly on the guiding rods 50.
19. Tensioning the harness by lifting shedding mechanism 22 until the couplings 36 are disconnected.
20. Programming the Jacquard machine 20 for the downward movement stage.
21. Slightly tightening the counterpressure plate 46.
22. Moving the counterpressure plate 46 including the male elements 78 to the downward movement stage end position.
23. Programming the Jacquard machine 20 for the upward movement stage, rotating the main shaft of the Jacquard machine 20 and moving counterpressure plate 46 holding the male elements 78 as far as to the first stops 53 to retain the male elements 78 in the conical openings 44. (This step prepares the seam weaving machine 10 for the mounting of a new harness.)
24. Relieving harness tension.
25. Pushing the deflector plate 48 onto the harness carriage guiding rods 102.
26. Disengaging the harness carriage guiding rods 102 from the Jacquard machine carriage guiding rods 50.

27. Removing the harness carriage 90 from the seam weaving machine 10.

The transfer of the shedding mechanism 22 from the seam weaving machine 10 to the harness carriage 90 is now concluded and another shedding mechanism 22 can be mounted on the seam weaving machine 10.

For the sake of simplicity it has been assumed in the above enumeration of steps that the upper and the lower harness frames 60, 62 form a one-piece element of the shedding mechanism 22, so that they are together attached to and detached from the harness carriage 90 and the Jacquard machine carriage 24. In practice, the upper harness frame 62 and the lower harness frame 60 are usually separate elements and solely the upper harness frame 62 is attached to the lifting mechanism 104 while the lower harness frame 60 is attached direct to the wall 98 of the harness carriage middle section 92. The lower harness frame 60 is usually transferred prior to the upper harness frame 62 from the harness carriage 90 to the Jacquard machine carriage 24.

Figure 12:
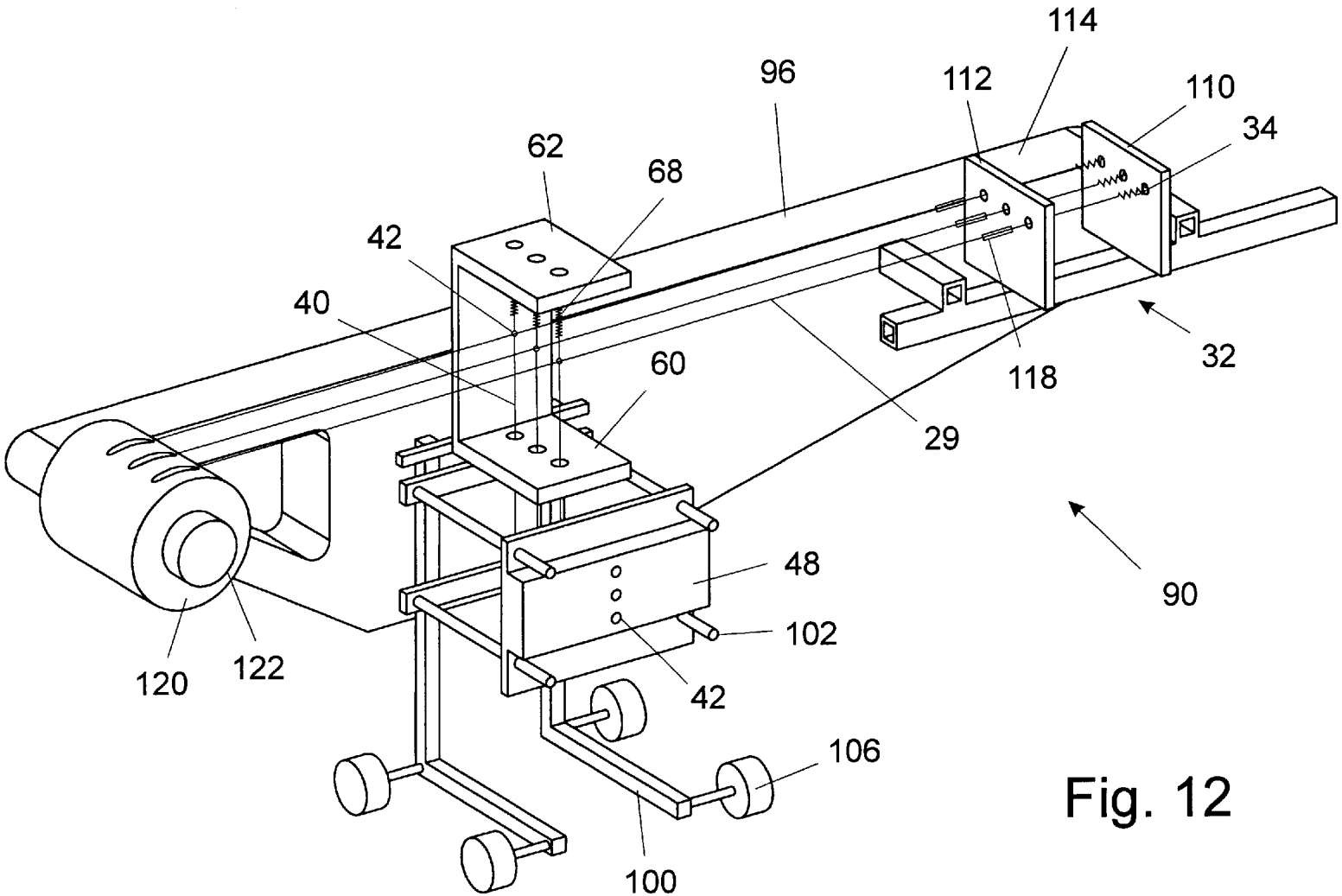
FIG. 12 is an isometric view of the harness carriage holding the deflector plate, the heddling device the seam strip bobbin and the tensioning device, all of the weft threads being drawn in through the eyelets and being drawn taut by the tensioning device and the fastening plate being removed.

In a preferred embodiment of the invention illustrated by FIGS. 3, 11 and 12, the tensioning device 32 in addition to the shedding mechanism 22 is designed such that it can be detached from the seam weaving machine 10 and transferred to the harness carriage 90 and vice versa. Such construction enables preparation of the shedding mechanism 22 while it is detached from the seam weaving machine 10 and mounted on the harness carriage 90. It enables in particular drawing in the seam strip weft threads 29 through the shedding mechanism 22 while it is mounted on the harness carriage 90 so that the seam weaving machine 10 does not have to be stopped while a new harness is being drawn in for the next fabric.

To this end, the harness carriage 90 comprises the right-hand and left-hand side sections 94, 96 cantilevered from opposite sides of the middle section 92 of the harness carriage 90.

The tensioning device 32 can be mounted on the left-hand side section 96 of the harness carriage 90 and comprises a base plate 110 and a storage plate 112 mounted parallel on a support plate 114 which in turn is mounted on the left-hand side section 96 of the harness carriage 90. The plurality of coil springs 34 are fastened to the base plate 110, the fastening points being arranged in rows and columns. The forward end of the coil springs 34 is connected by short strings to the weft thread couplings 118. A plurality of counterbored holes is provided in the storage plate 112. The counterbored holes are arranged in rows and columns so that each of the holes is in registry with one of the coil spring fastening points on the base plate 110. As long as the weft thread couplings 118 are not connected with the seam strip weft threads 29 they will be drawn by the coil springs 34 half-way through the counterbored holes in the storage plate 112 so that an enlarged diameter portion of the weft thread couplings 118 abuts to the shoulder in the counterbored holes (position X in FIG. 11). When the weft thread couplings 118 are connected to seam strip weft threads 29, the coil springs 34 will be extended so that the weft thread couplings 118 are in a position in front of the storage plate 112 (position Y in FIG. 11). The construction of the tensioning device 32 is conventional so that it is not shown in detail in the drawings.

A bobbin 120, on which the seam strip weft threads 29 can be wound, is mounted on a bobbin support 122 on the right-hand side section 94 of the harness carriage 90. A clamping plate 128 is provided for between the shedding mechanism 22 on the middle section and the bobbin 120 and somewhat offset away from the wall 98 in FIG. 3. The forward end of the seam strip 28 can be held by this clamping plate 128.

All operations necessary for drawing in the weft threads 29 through the shedding mechanism 22 can be carried out on the harness carriage 90 separated from the seam weaving machine 10. The harness carriage 90 is moved to a special drawing-in site for threading in the weft threads 29 through the shedding mechanism 22. The drawing-in site comprises a wall from which four guiding rods extend horizontally like the Jacquard machine carriage guiding rods 50 so that the harness carriage 90 can be docked onto that drawing-in site by means of the guiding rods. The purpose of that docking on is to be able to move the deflector plate 48 somewhat away from its position beneath the shedding mechanism 22 held on the harness carriage 90 so that the harness cords 40 are stretched taut, which facilitates threading the weft threads 29 through the eyelets 42 in the shedding mechanism 22. It would be difficult and cumbersome to thread the weft threads 29 if the harness cords 40 were to be slack and got entangled.

A transverse ribbon is cut from one of the ends of the fabric to form the seam strip 28. That seam strip 28 has a width of, for example, 10 cm. The warp threads are removed from the ribbon with the exception of within the end portions so that full length weft threads 29 are obtained which are held together at their ends by the interwoven warp threads. The first end portion is fixed to the bobbin 120 and the seam strip weft threads 29 are wound on the bobbin 120. If necessary, a paper layer can be wound together with the weft threads 29 so that the wound layers of the weft threads 29 are separated by the paper layer. The second end portion 126 of the seam strip 28 is then drawn away from the bobbin 120 up to the tensioning device 32 so that the bobbin 120 is partially unwound and there is a distance of about 30 cm between the end of the weft threads held in the second end portion 126 and the storage plate 112 of the tensioning device 32 when the weft threads 29 are straight. The second end portion 126 is then fastened on a clamping plate 128 which is provided for between the shedding mechanism 22 and the bobbin 120 and somewhat offset away from the wall 98. The weft thread 29 nearest to the wall 98 is drawn out of the second end portion 126 held by the clamping plate 128, drawn through the corresponding eyelet 42 of the shedding mechanism 22 and fastened to the corresponding weft thread coupling 118. The weft thread coupling 118 is connected to the coil spring 34 which in turn is fastened to the base plate 110 of the tensioning device 32 so that the weft thread 29 is tensioned. All further weft threads 29 in the second end portion 126 are, one after the other, separated from the second end portion 126 held by the clamping plate 128, drawn in through the corresponding eyelet 42 and fastened to the corresponding weft thread coupling 118.

When all of the weft threads 29 are drawn in through the shedding mechanism 22 and fastened to the weft thread couplings 118, the new harness is completed so that it can be mounted to the seam weaving machine 10. The clamping plate 128 will be removed at this juncture because it would otherwise interfere with the Jacquard machine 10 when the harness carriage 90 is moved to the seam weaving machine 10 so that the points of the harness carriage guiding rods engage the points of the Jacquard machine carriage guiding rods. FIG. 12 shows the harness carriage 90 with the new harness and all the weft threads 29 drawn in through the eyelets 42. For the sake of clarity, only three weft threads 29 are shown in FIG. 12. In reality, some hundreds of weft threads are drawn in.

It will be assumed that the fabric last made endless has been taken from the seam weaving machine 10 so that the seam weaving machine 10 is "empty" and that at least the support element 12 proximal to the harness carriage 90 has been removed, as shown in FIGS. 3 and 4. The various parts of the seam weaving machine 10 and the new harness have to be in the positions, and the steps have to be carried out, as described above for the embodiment in which the shedding mechanism without the seam strip weft threads has been transferred.

The tensioning device 32 can be transferred from the harness carriage 90 to the seam weaving machine 10 before or after the transfer of the shedding mechanism 22 and the deflector plate 48. In each case, the tensioning device 32 is clamped by the clamping jaws 13 only to the single support element 12 installed at this juncture (FIG. 3) in the seam weaving machine 10. The tensioning device 32 is provided with an extendable leg or is supported in any other manner so that it is held in its final position and does not hang down from the single support element 12. Likewise, the seam strip weft threads 29 can be unwound from the bobbin 120 and the first end portion of the seam strip 28 can be fastened to the fastening plate 30 attached to the forward standard 14 before or after the transfer of the shedding mechanism 22 and the deflector plate 48.

When the first end portion of the seam strip 28 has been attached to the fastening plate 30, the tensioning device 32, the deflector plate 48 and the shedding mechanism 22 have been transferred and the couplings 36 have been connected, the harness carriage 90 is empty and can be removed. After removal of the empty harness carriage 90 from the seam weaving machine 10, the second elongate support element 12 can be installed, the tensioning device can also be clamped by the clamping jaws 13 to the second elongate support element 12, a new fabric can be laid into the seam weaving machine 10, the opposite ends 17 of a fabric 18 can be clamped to the support elements 12 and, finally, the fabric 18 can be made endless by a woven seam 19.

What is claimed is:

1. A method for mounting a new harness on a seam weaving machine for making endless a flat woven fabric formed by interwoven warp and welt threads by means of a woven seam joining together opposite ends of a fabric, the opposite ends of the fabric each including a fringe of warp threads, the warp threads of the fringe being supported such that they can be interwoven with weft threads taken out of the fabric and drawn in through a shedding mechanism controlled by a Jacquard machine by means of twines and harness cords so that the weft threads drawn in form a shed opening, each of the harness cords being passed through one of a number of openings in a first plate, the harness cords being connected to the twines by means of couplings, each of the twines passing through one of a number of openings in a second plate, each coupling comprising a first and second coupling element, each of the first coupling elements being fastened to a number of the harness cords and each of the second coupling elements being fastened to a twine, the first and second coupling elements being connectable by movement to a first position relative to each other and are disconnectable by movement to a second position relative to each other; the method comprising the steps of:

providing a harness carriage including first means for releasably supporting the shedding mechanism and second means for releasably supporting the first plate;

installing the shedding mechanism on the first supporting means;

installing the first plate on the second supporting means;

transferring the first plate from the second supporting means to the seam weaving machine and moving the first plate to the second plate so that all couplings will be moved together into the first position so that the harness cords extending from the shedding mechanism are connected to the twines extending from the Jacquard machine; and releasing the shedding mechanism from the first supporting means of the harness carriage and fastening the shedding mechanism to the seam weaving machine.

2. The method of claim 1 further comprising moving the first and second coupling elements in a direction along an axis of the first and second coupling elements to connect and disconnect the first and second coupling elements.

3. The method of claim 1 comprising the step of drawing in the weft threads through the shedding mechanism while the shedding mechanism is attached to the harness carriage and fastening them to a tensioning device releasably attached to the harness carriage.

4. The method of claim 3 comprising the step of transferring the tensioning device from the harness carriage to the seam weaving machine.

5. A seam weaving machine for making endless a flat woven fabric formed by interwoven warp and weft threads by means of a woven seam joining together opposite ends of the fabric, the opposite ends of the fabric each including a fringe of warp threads, the warp threads of the fringe being supported such that they can be interwoven with weft threads taken out of the fabric and thereby form the woven seam, the machine comprising, a shedding mechanism for receiving weft threads of the fabric and being controllable by harness cords to form a shed opening into which the warp threads of the fringe can be drawn through for interweaving with the weft threads;

a Jacquard machine for controlling the shedding mechanism by means of twines connectable to the harness cords;

separable couplings for selectively connecting and disconnecting the twines to the harness cords, each coupling comprising a first and second coupling element, the first coupling element being fastened to at least one of the harness cords and the second coupling element being fastened to one of the twines, the first and second coupling elements being connectable by their relative movement up to a first position so that the harness cords are connected to the twines of the Jacquard machine and are disconnectable by further movement up to a second position so that the harness cords are disconnected from the twines of the Jacquard machine;

A first plate having a number of openings for passage therethrough of the harness cords;

A second plate having a number of openings for passage therethrough of the twines;

wherein the first plate and second plate are movable relative to each other so that all separable couplings can together be moved into the first and second position; and wherein the shedding mechanism, the harness cords, the first coupling elements and the first plate are removably connectable to the seam weaving machine.

6. The machine of claim 5 wherein the first and second coupling elements are connectable in a direction along the axis of the first and second coupling elements.

7. The machine of claim 5 comprising a harness carriage including means for holding the shedding mechanism, including the harness cords connected thereto and the first coupling elements fastened thereto, and the first plate in the same relative position as when they are connected with the seam weaving machine so that they are transferable from the seam weaving machine to the harness carriage.

8. The machine of claim 7 wherein the harness carriage includes a support for storing the weft threads to be drawn in through the shedding mechanism and a tensioning device for tensioning the drawn-in weft threads, the weft thread support being releasably attached to the harness carriage and the tensioning device being transferable from the seam weaving machine to the harness carriage.

9. The machine of claim 7 wherein the harness carriage includes a support for the shedding mechanism, the support including means for lowering and raising the shedding mechanism so that the harness cords can be tensioned and slackened.

* * * * *